US006365020B1

(12) United States Patent
Yoshioka et al.

(10) Patent No.: US 6,365,020 B1
(45) Date of Patent: Apr. 2, 2002

(54) WAFER PLATING JIG

(75) Inventors: Junichiro Yoshioka; Kenya Tomioka; Satoshi Sendai; Atsushi Chono, all of Tokyo; Naomitsu Ozawa, Kanagawa, all of (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/600,028

(22) PCT Filed: Jan. 12, 1999

(86) PCT No.: PCT/JP99/00059

§ 371 Date: Jul. 11, 2000

§ 102(e) Date: Jul. 11, 2000

(87) PCT Pub. No.: WO99/35309

PCT Pub. Date: Jul. 15, 1999

(30) Foreign Application Priority Data

Jan. 12, 1998 (JP) ..... 10-018151

(51) Int. Cl.[7] ..... C25B 9/02

(52) U.S. Cl. ..... 204/297.09; 204/297.1; 204/297.14

(58) Field of Search ..... 204/297.07, 297.09, 204/297.1, 297.14

(56) References Cited

U.S. PATENT DOCUMENTS 2,739,117 A * 3/1956 Luechauer et al. .... 204/297.09
3,461,059 A * 8/1969 Krueger ..... 204/297.09
4,405,431 A * 9/1983 Pfeifer et al. ..... 204/297.09
4,971,676 A * 11/1990 Doue et al. ..... 204/297.1
6,152,436 A * 11/2000 Sonderegger et al. .. 204/297.14
6,228,231 B1 * 5/2001 Uzoh ..... 204/297.1

FOREIGN PATENT DOCUMENTS

| | | |
|---|---|---|
| JP | 61-187379 | 11/1986 |
| JP | 62-93397 | 4/1987 |
| JP | 62-188798 | 8/1987 |
| JP | 5-222587 | 8/1993 |
| JP | 8-13198 | 1/1996 |

* cited by examiner

*Primary Examiner*—Bruce F. Bell
(74) *Attorney, Agent, or Firm*—Wenderoth, Lind & Ponack, L.L.P.

(57) ABSTRACT

The present invention is to provide a wafer plating jig for a plating apparatus having a simple construction and capable of sealing conducting pins from the plating solution completely. The wafer plating jig for gripping a wafer, comprises a main jig body (11) having a plurality of gripping mechanisms (13) and a plurality of conducting pins disposed thereon. A seal packing (20) is provided to surround each of the conducting pins. When the wafer is gripped by the gripping mechanisms (13), each end of the conducting pins individually contacts conductive film formed on the wafer and being sealed by the seal packing (20).

4 Claims, 6 Drawing Sheets

10
11
13
16
22
23
W

WAFER PLATING JIG

TECHNICAL FIELD

The present invention relates to a wafer plating jig in which a semiconductor wafer is mounted during a plating process.

BACKGROUND ART

FIG. 1 shows the general construction of a wafer plating apparatus. The wafer plating apparatus is provided with a plating bath 1 accommodating a plating solution Q, a plating jig 2 disposed in the plating solution Q accommodated in the plating bath 1, a wafer 3 mounted in the plating jig 2, an anode 4 also disposed in the plating solution Q opposite the wafer 3, and a power source 5 connected between the plating jig 2 and the anode 4 for supplying an electrical current from the anode 4 to the plating jig 2 in order to form a plating film on the surface of the wafer 3. In addition, a collecting vessel 6 is provided around the outside of the plating bath 1 to collect plating solution Q that overflows from the plating bath 1. A circulating pump 7 is provided to circulate plating solution Q collected in the collecting vessel 6 back to the plating bath 1, supplying the plating solution Q into the bottom of the plating bath 1.

In the wafer plating apparatus described above, a plurality of conducting pins (not shown) are provided on the plating jig 2 for contacting the conductive layer formed on the surface of the wafer 3 mounted in the plating jig 2. A plating layer is formed on the surface of the wafer 3 by supplying an electrical current from the anode 4 to the conductive film on the wafer 3 via the conducting pins. Hence, an electrical current flows through the conducting pins when plating the wafer 3. However, since plating matter also becomes deposited on the ends of the conducting pins, it is occasionally necessary to perform a process to remove these deposits from the pins.

In another method well known in the art, the conducting pins are sealed from the plating solution Q in order to prevent plating matter from depositing on the ends of the conducting pins. However, no conventional wafer plating apparatus with a simple construction has included a seal construction capable of completely sealing individual conducting pins from the plating solution Q.

DISCLOSURE OF INVENTION

In view of the foregoing, it is an object of the present invention to provide a wafer plating jig for a plating apparatus having a simple construction and being capable of sealing individual conducting pins from the plating solution.

To solve the above subject matter, there is provided a wafer plating jig, comprising: a main jig body having a plate shape, an opening being formed in the center thereof; and a plurality of gripping mechanisms and a plurality of conducting pins disposed around a periphery of the opening for gripping the wafer and conducting electricity to the same; said gripping mechanism comprising: a base support; a holder rotatably fixed on a hinge pin supported on the base support; a coil spring for urging the front end of the holder toward a surface of the main jig body for gripping the wafer; a conducting pin positioned in the base support opposite the front end of the holder, said conducting pin being covered by a seal packing; wherein the wafer is gripped in the gripping mechanisms between the front ends of the holders and the conducting pins.

According to another aspect of the present invention, there is provided a wafer plating jig wherein the seal packing is formed by molding surrounding the conducting pin and has a bell-shaped, and end of the bell-shaped seal packing is protruding a prescribed length past the end of the conducting pin.

According to another aspect of the present invention, there is provided a wafer plating jig wherein: the gripping mechanism is provided with a cylinder formed of resin, which is inserted between the hinge pin and the coil spring.

According to another aspect of the present invention, there is provided a wafer plating jig wherein the wafer plating jig is provided with an open/close jig for connecting the rear ends of the holders of the gripping mechanisms commonly, so that the plural of gripping mechanisms is simultaneously opened or closed thereby.

BEST MODE FOR CARRYING OUT THE INVENTION

A wafer plating jig according to a preferred embodiment of the present invention will be described while referring to the accompanying drawings.

Figure 1:
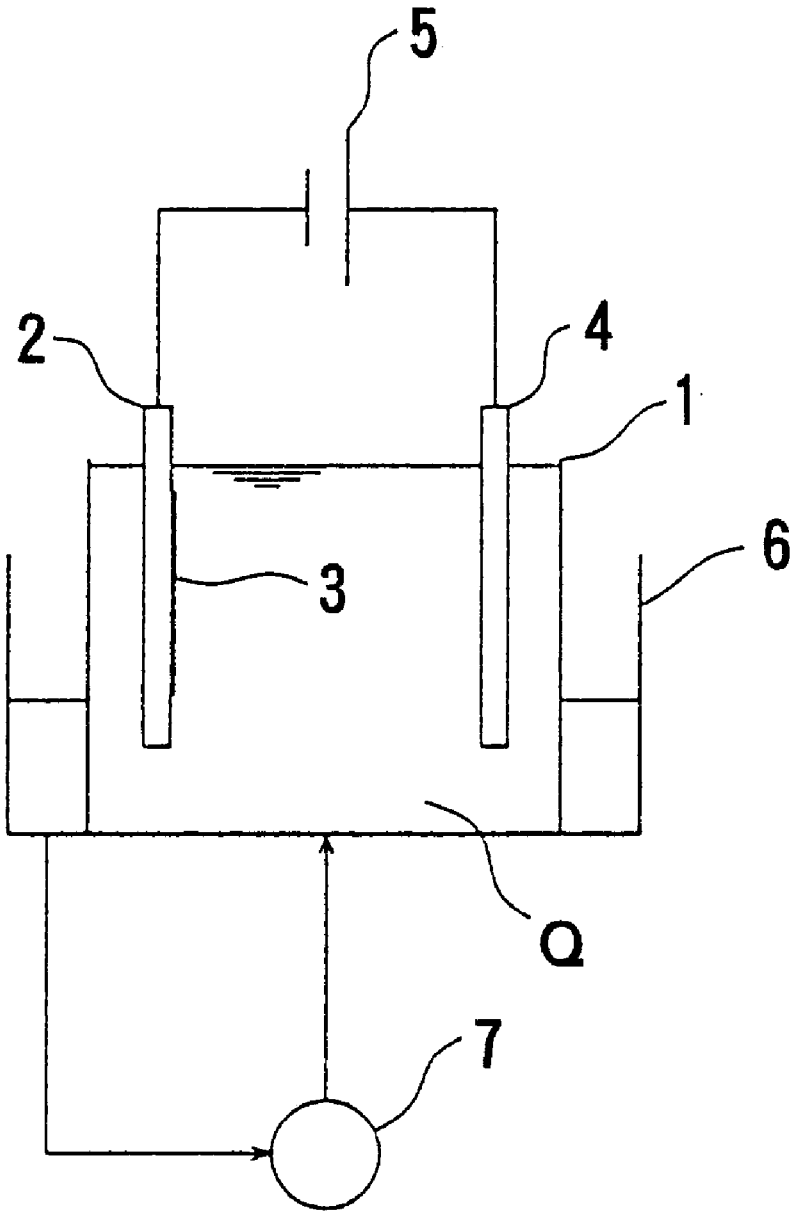
FIG. 1 shows the general construction of a wafer plating jig according to the prior art.
Figure 2B:
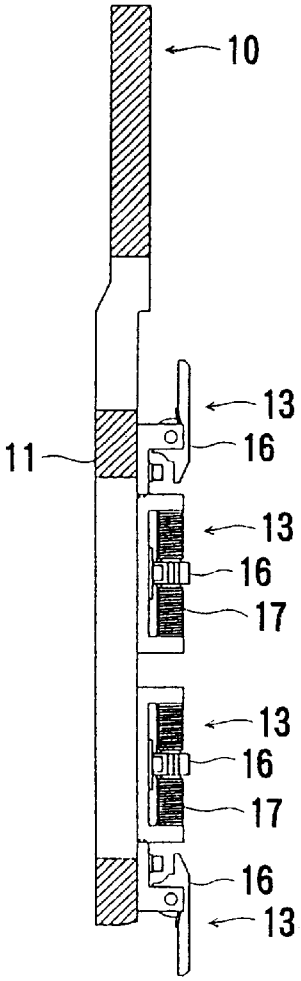
FIG. 2A is a plan view and FIG. 2B is a cross-sectional view along the plane and in the direction indicated by the line AA in FIG. 2A showing the construction of a wafer plating jig according to the present invention.
Figure 2A:
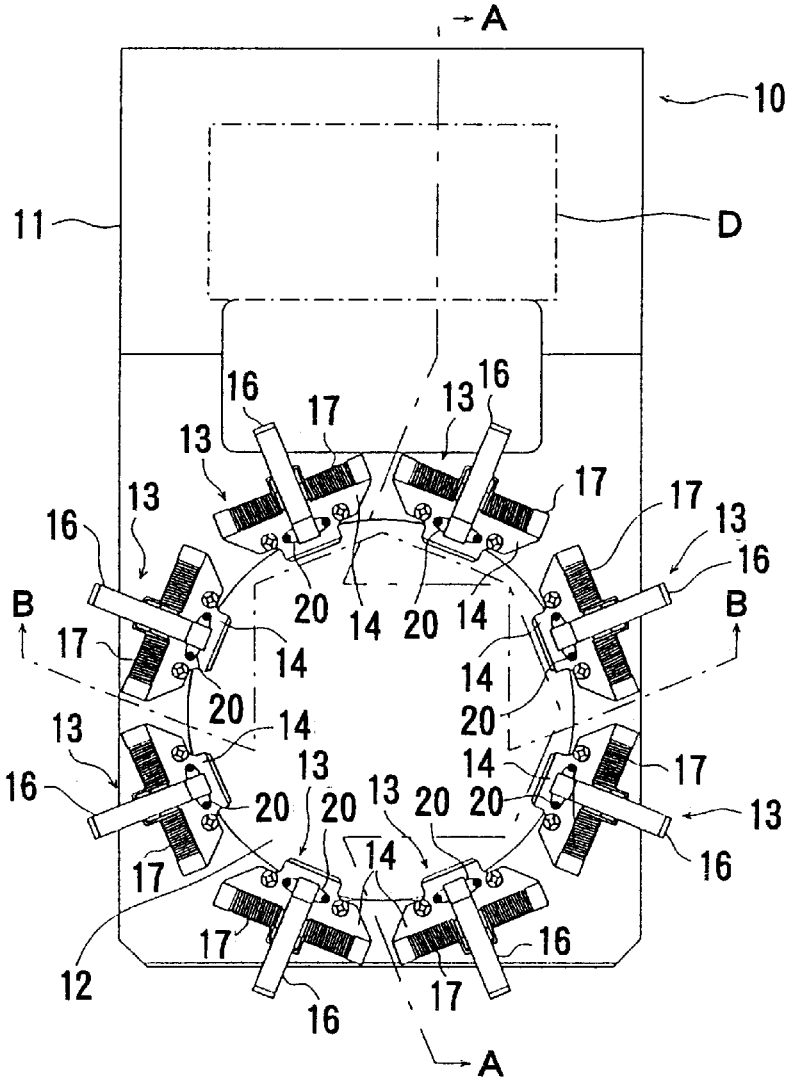

FIGS. 2A and 2B shows a plan view and cross-sectional view of the wafer plating jig according to the preferred embodiment. As shown in the diagram, the wafer plating jig 10 is provided with a plate-shaped main body 11, a circular opening 12 formed in the center of the main body 11, and a plurality (eight, in the current example) of gripping mechanisms 13 mounted around the circumference of the circular opening 12 for gripping a wafer W.

FIGS. 3A–3D shows a plan view, side view, rear view, and cross-sectional view showing the construction of the gripping mechanisms 13. Each gripping mechanism 13 is provided with a base 14 having a supporting portion 14*a* on both ends, a hinge pin 15, a holder 16, and a coil spring 17. The hinge pin 15 is supported between the two supporting portions 14*a*, 14*a*. The holder 16 is rotatably supported on the hinge pin 15. The holder 16 has a front end 16*a* and a back end 16*b*. The coil spring 17 provided around the hinge pin 15 urges the front end 16*a* of the holder 16 toward the bottom of the base 14 (see arrow B in FIG. 3B). The base 14 is fixed to the main body 11 by screws 18,18.

Figure 3A:
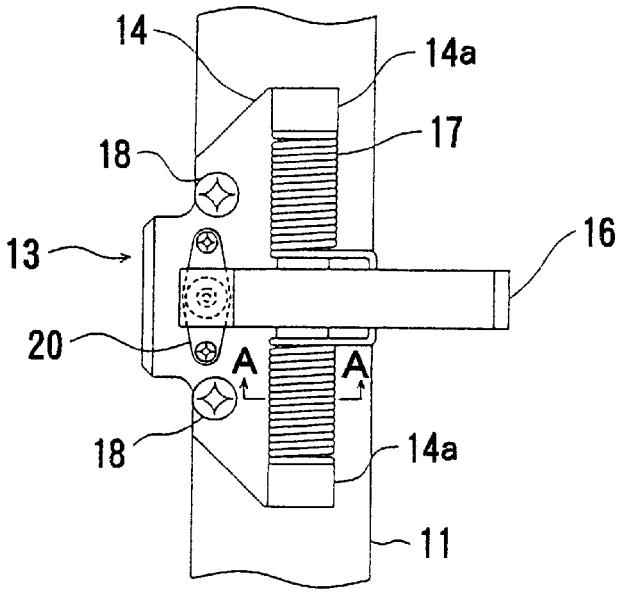
FIG. 3A is a plan view.
Figure 3B:
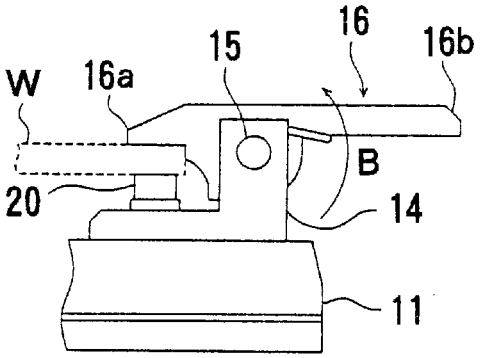
FIG. 3B is a side view.
Figure 3C:
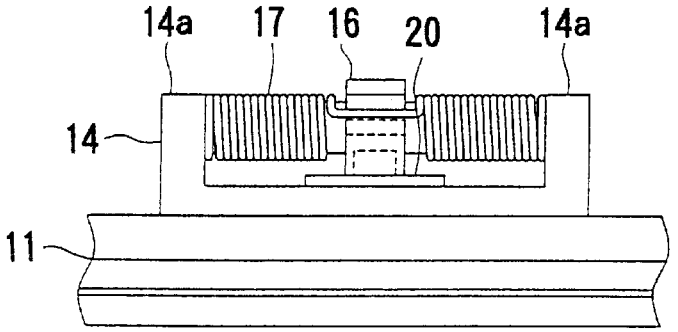
FIG. 3C is a rear view.
Figure 3D:
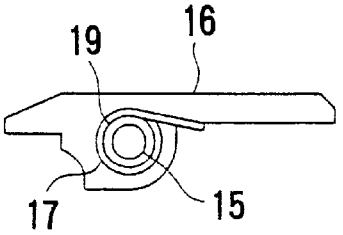
FIG. 3D is a cross-sectional view along the line and direction indicated by the arrows AA in FIG. 3A, which shows the construction of a gripping mechanism used in the wafer plating jig according to the present invention.

As shown in FIG. 3D, a cylindrical resinous sleeve 19 is interposed between the coil spring 17 and hinge pin 15.

Accordingly, the position of the coil spring 17 around the hinge pin 15 is maintained by the resinous sleeve 19, thereby improving the stability of the rotating force that is generated by the urging force of the coil spring 17.

Figure 4A:
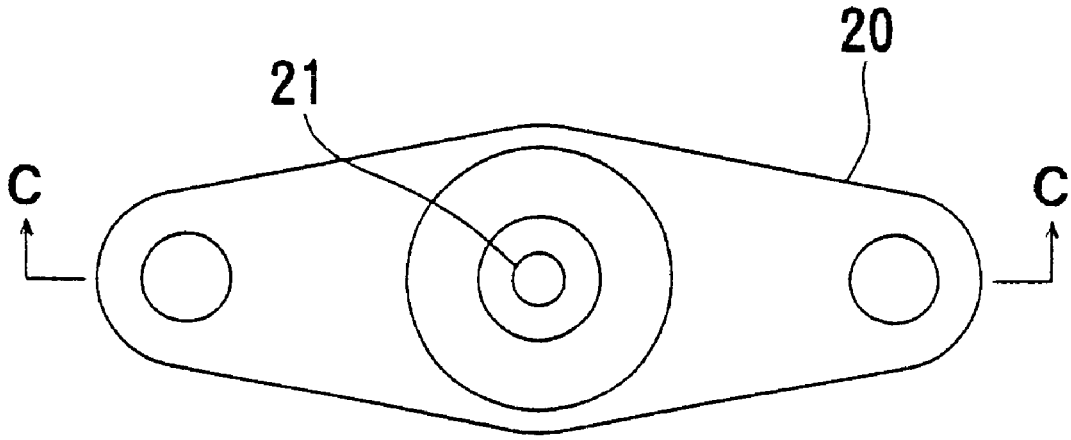
FIG. 4A is a plan view and FIG. 4B is a cross-sectional view along the line and in the direction indicated by the arrows CC in FIG. 4A showing the construction of a conducting pin and seal packing used in the wafer plating jig according to the present invention.
Figure 4B:
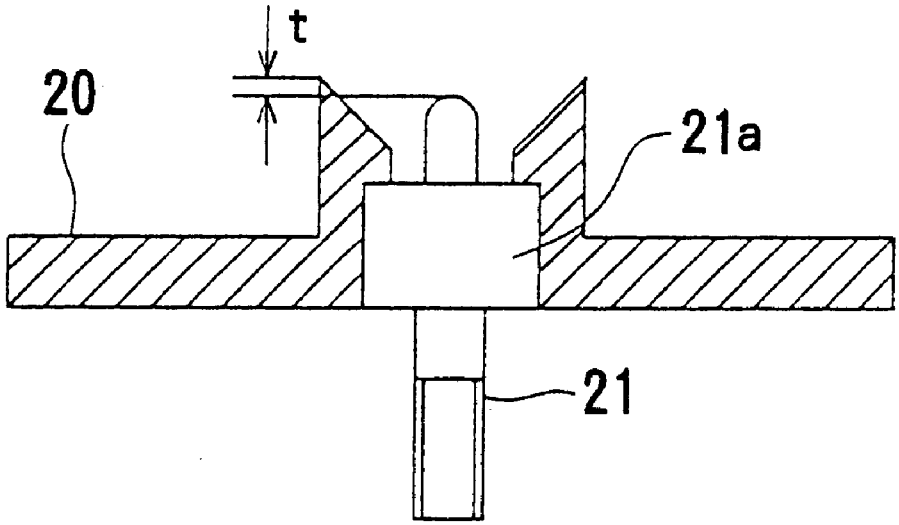

A conducting pin 21 shown in FIGS. 4A and 4B having an enlarged diameter portion 21*a* is disposed in a position opposing the front end 16*a* of the holder 16. A seal packing 20 formed of silicone rubber, fluoro rubber, or the like is molded to cover the conducting pin 21 and fit around the enlarged diameter portion 21*a* of the conducting pin 21. A bell-shaped protruding end of the seal packing 20 protrudes a prescribed dimension t over the ends of the conducting pin 21. FIGS. 4A and 4B show a plan view and cross-sectional view respectively of the seal packing 20 and conducting pin 21.

By pressing down on the back end 16*b* of the holder 16, the holder 16 resists the urging force of the coil spring 17 and opens by rotating around the hinge pin 15. When the back end 16*b* is released, the urging force of the coil spring 17 causes the holder 16 to rotate back in the opposite direction around the hinge pin 15 until closed. When a wafer W is interposed between and gripped by the end of the conducting pin 21 and front end 16*a* of the holder 16, as shown in FIG. 3B, the end of the conducting pin 21 contacts the conductive film formed on the surface of the wafer W. At the same time, the cylindrically shaped protruding end of the seal packing 20 contacts the surface of the wafer W. With this construction, the seal packing 20 completely seals in the conducting pin 21, preventing plating solution from contacting the same. With its bell shape, the protruding end of the seal packing 20 is capable of forming a close contact with the surface of the wafer W, thereby producing a sealing effect.

Figures 5A, 5B:
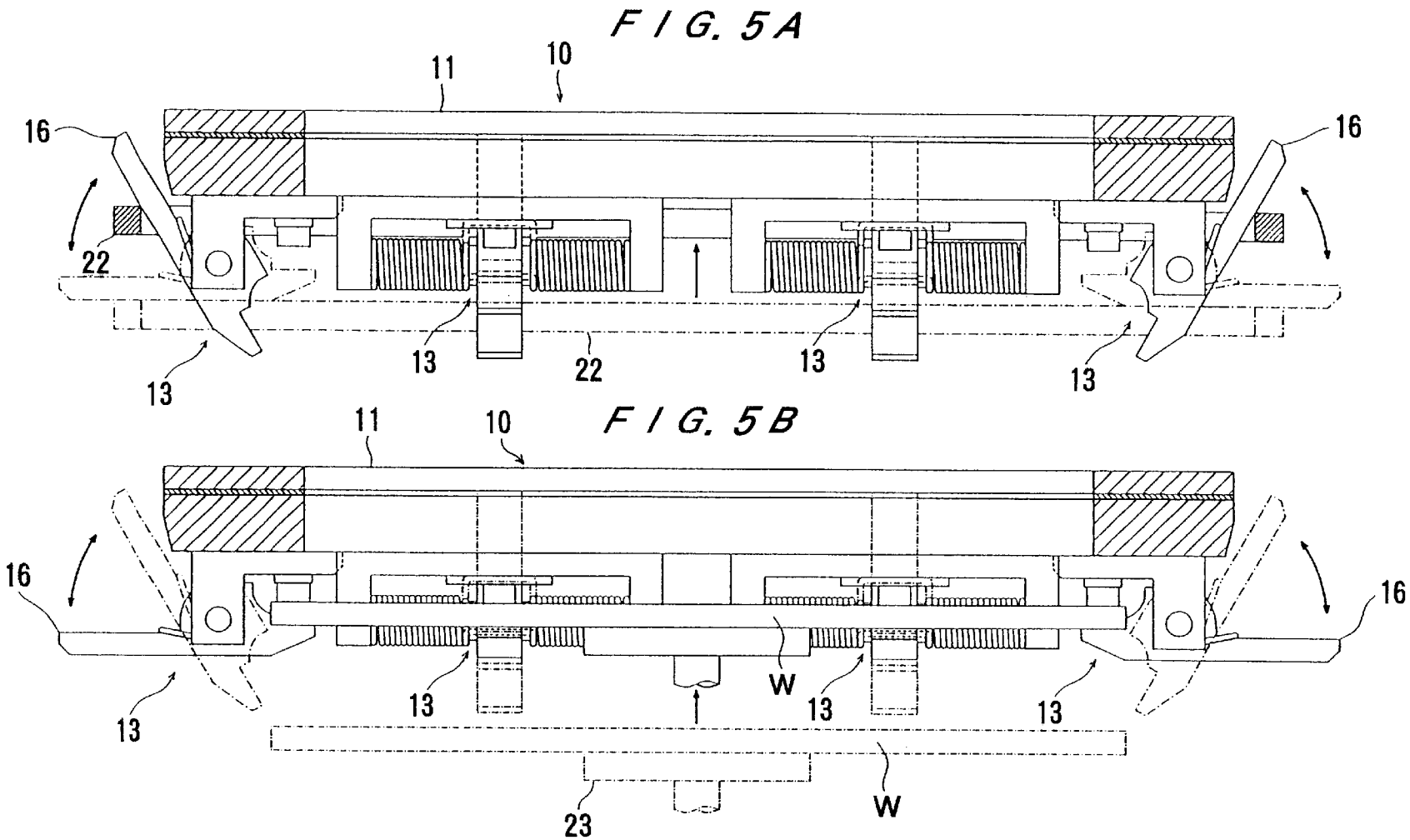
FIGS. 5A and 5B are explanatory diagrams showing the procedure for mounting a wafer in the wafer plating jig according to the present invention.

With a wafer plating jig having the construction described above, an open/close jig 22 is provided to push on each of the back ends 16*b* of the holders 16 for opening/closing all of gripping mechanism 13 simultaneously, as shown in FIG. 5A. The open/close jig 22 pushes upward on the bottom of the back end 16*b* of the holder 16. At the same time, a jig 23 transfers the wafer W to a position near the ends of the plurality of conducting pin 21, as shown in FIG. 5B. From this position, the open/close jig 22 is lowered to position the wafer W automatically by closing the gripping mechanisms. The surface of the holder 16 opposing the ends of the wafer W is configured to push the wafer W in a direction toward the center of the circular opening 12 as the holder 16 rotates about the hinge pin 15. Hence, by simultaneously rotating the plurality of holder 16 in the closing direction, the wafer W is automatically locked into a position. At this time, the wafer W is gripped between the front ends 16*a* of the holders 16 and the ends of the conducting pins 21.

As described above, the seal packing 20 is formed by molding into a cylindrical shape to fit around the periphery of the conducting pin 21. Moreover, since the protruding end of the seal packing 20 is formed in a bell shape, when the seal packing 20 contacts the surface of the wafer W, the seal formed thereby has a small surface area. Accordingly, it is possible to form a tight seal with only a small amount of pushing force. Hence, each of the conducting pins 21 is completely sealed inside the seal packing 20. Further, since the seal packing 20 is formed by molding to fit around the conducting pin 21, the positional relationship between the ends of the conducting pin 21 and the ends of the seal packing 20 are fixed (the dimension t shown in FIG. 4B is fixed), thereby achieving a stable seal.

Figure 6B:
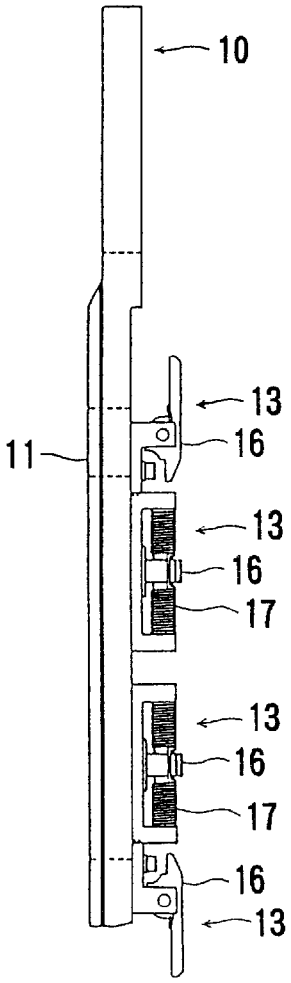
FIG. 6A is a plan view and FIG. 6B is a side view showing the construction of a wafer plating jig according to the present invention.
Figure 6A:
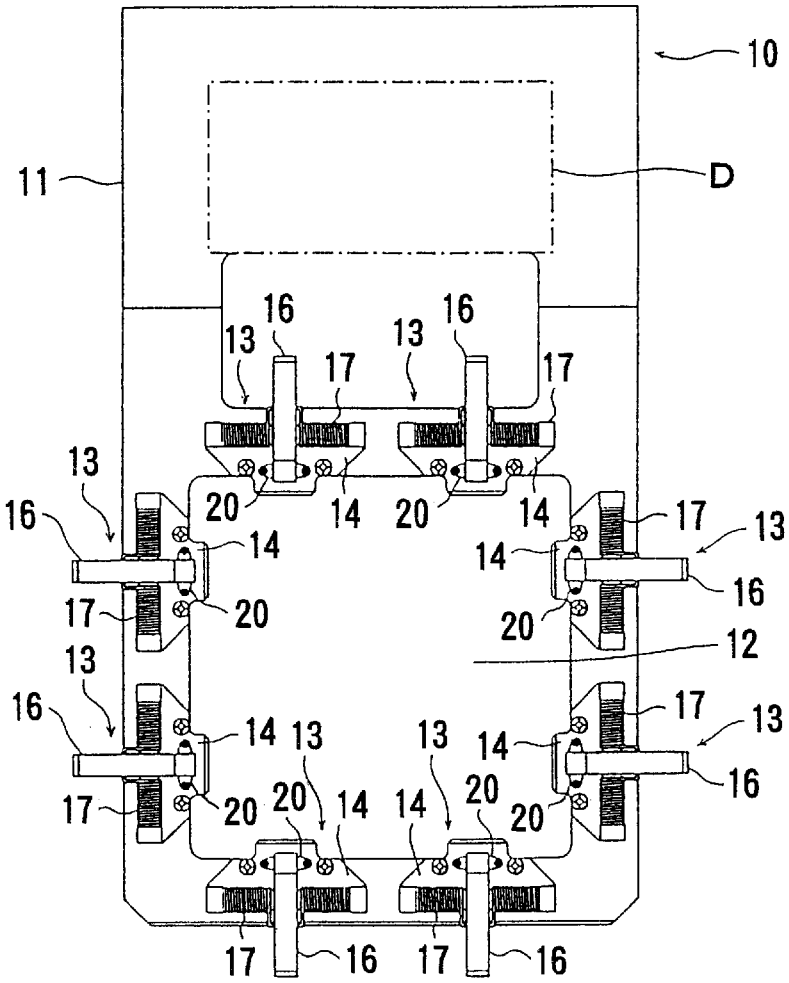

In the plating jig 10 described above, the circular opening 12 is formed in the plate-shaped main body 11. However, the circular opening 12 is not limited to a circular shape but can also have a rectangular shape, for example. FIGS. 6A and 6B show a plating jig 10 having a rectangular opening 12 and a plurality of gripping mechanisms 13 disposed around the peripheral edge of the opening.

Various electronic components may also be mounted in the area D of the plating jig 10 shown in FIG. 2, such as a component provided to supply electricity to the wafer W via the conducting pins 21. However, since these electronic components are not directly related to the present invention, a description of them has been omitted.

(1) As described in the embodiment above, the gripping mechanisms disposed around the periphery of the opening of the main jig body grip the wafer to be plated at the periphery thereof and conduct an electric current, principal portion of the wafer is exposed to be plated at the opening of the main jig body. Since the holder is rotated and opened around the hinge pin against the urging force of the coil spring, the wafer can be loaded by pushing the holder. And, since the holder is rotated and closed around the hinge pin by the urging force of the coil spring, the wafer can be mounted in the plating jig and positioned automatically to be aligned at the opening of the main jig body by releasing the holder. Further more, seal packing is provided around the conducting pins on the wafer plating jig in order to hermetically seal in the conducting pins when the wafer has been gripped by the gripping mechanisms. Since the surface area formed by the seal is small, a strong seal can be achieved with a small amount of pushing force.

(2) As described in the embodiment above, the seal packing is formed by molding around the conducting pins, and the protruding end of the seal packing is bell-shaped and protrudes a prescribed distance past the end of the conducting pin. Accordingly, a stable seal is possible because the positional relationship between the ends of the conducting pins and the ends of the seal packing is uniform.

(3) As described in the embodiment above, a resinous sleeve is inserted between the hinge pin and the coil spring. Accordingly, the position of the coil spring in relation to the hinge pin is maintained by the resinous sleeve, thereby achieving a more stable force for rotating the holder.

(4) As described in the embodiment above, the wafer plating jig is configured to automatically position the wafer by the opening and closing operation of the gripping mecha nisms. Accordingly, the wafer can be easily positioned in the mounting area of the plating jig by simply opening and closing the plurality of gripping mechanisms simultaneously.

INDUSTRIAL APPLICABILITY

The present invention is appropriate for use in an apparatus, which is used to plate a semiconductor wafer or the like.

What is claimed is:

1. A wafer plating jig for gripping a wafer, comprising:

a main jig body having a plate shape, an opening being formed in the center thereof; and a plurality of gripping mechanisms and a plurality of conducting pins disposed around a periphery of the opening for gripping the wafer and conducting electricity to the same;

said gripping mechanism comprising:

a base support;

a holder rotatably fixed on a hinge pin supported on the base support;

a coil spring for urging the front end of the holder toward a surface of the main jig body for gripping the wafer;

a conducting pin positioned in the base support opposite the front end of the holder, said conducting pin being covered by a seal packing;

wherein the wafer is gripped in the gripping mechanisms between the front ends of the holders and the conducting pins.

2. A wafer plating jig as claimed in claim 1, wherein the seal packing is formed by molding surrounding the conducting pin and has a bell-shaped, and end of the bell-shaped seal packing is protruding a prescribed length past the end of the conducting pin.

3. A wafer plating jig as claimed in claim 1, wherein the gripping mechanism is provided with a cylinder formed of resin, which is inserted between the hinge pin and the coil spring.

4. A wafer plating jig as claimed in claim 1, wherein the wafer plating jig is provided with an open/close jig for connecting the rear ends of the holders of the gripping mechanisms commonly, so that the plural of gripping mechanisms is simultaneously opened or closed thereby.

* * * * *